United States Patent [19]

Atack et al.

[11] Patent Number: 4,671,091

[45] Date of Patent: Jun. 9, 1987

[54] ROLLING MILL

[75] Inventors: Philip A. Atack, Broadstone; Trevor A. Gore; Michael Masterman, both of Bournemouth, all of England

[73] Assignee: Davy McKee (Poole) Limited, Dorset, England

[21] Appl. No.: 715,938

[22] Filed: Mar. 25, 1985

[30] Foreign Application Priority Data

Mar. 23, 1984 [GB] United Kingdom ..... 8407669

[51] Int. Cl.[4] ..... B21B 27/10

[52] U.S. Cl. ..... 72/45; 72/201; 72/236

[58] Field of Search ..... 72/43, 44, 45, 200, 72/201, 236

[56] References Cited

U.S. PATENT DOCUMENTS

| | | | |
|---|---|---|---|
| 2,056,433 | 10/1936 | Matthews | 72/201 |
| 2,107,541 | 2/1938 | Long | 72/201 |
| 3,208,253 | 9/1965 | Roberts | 72/201 X |
| 3,994,151 | 11/1976 | Stock et al. | 72/201 |
| 4,247,047 | 1/1981 | Schaming | 72/201 X |
| 4,272,976 | 6/1981 | Pizzedaz | 72/45 |
| 4,467,629 | 8/1984 | Schimion | 72/236 X |

FOREIGN PATENT DOCUMENTS

| | | | |
|---|---|---|---|
| 914725 | 7/1954 | Fed. Rep. of Germany . | |
| 3049490 | 7/1982 | Fed. Rep. of Germany . | |
| 37-69 | 1/1962 | Japan | 72/201 |
| 47-44867 | 11/1972 | Japan . | |
| 512810 | 5/1976 | U.S.S.R. | 72/236 |

*Primary Examiner*—E. Michael Combs

*Attorney, Agent, or Firm*—Schwartz, Jeffery, Schwaab, Mack, Blumenthal & Evans

[57] ABSTRACT

Coolant is applied to the rolls (12–14) of a rolling mill at the ingoing side of the mill by nozzles (22) which are located in casings (23, 24). The casings are sealed to the rolls by contact seals (25, 26, 30, 31) and by edge seals (19) so that coolant is entirely contained within the casings and is prevented from coming into contact with the work being rolled (16). Roll lubricant is directed by nozzles 80 on to the work rolls (12, 13) and the work (16) outside the confines of the casings.

18 Claims, 9 Drawing Figures

ROLLING MILL

BACKGROUND OF THE INVENTION

This invention relates to rolling mills and methods of rolling metal in rolling mills.

It is customary in rolling mills to apply a coolant to the rolls and/or the work to hold the temperature of the work within reasonable limits regardless of the heat generated during rolling. The coolant is usually water or is water-based, and includes a rolling lubricant; an oil-water emulsion is frequently employed.

When water-based coolant contacts aluminium strip, it reacts with the aluminium to cause staining of the strip surface, which may inhibit the action of the rolling lubricant, even if applied separately from the coolant. The result is that the reduction effected in the mill is non-uniform across the strip width so that strip with poor flatness is produced. Further, the hardness of the stained areas differs from that of the remainder of strip and that causes unequal reduction in any subsequent rolling operation and further loss of flatness. Lastly, the appearance of the rolled material is marred.

In British patent specification No. 1511247, corresponding to U.S. Pat. No. 3,994,151, it has been proposed to confine the application of coolant, which preferably contains rolling lubricant, to the rolls, no coolant being directed on to the work. The coolant is applied to the rolls at the outgoing side of the mill by nozzles which are enclosed in casings sealed to the work rolls and their back-up rolls by the use of air seals. Lubricant contained in the coolant is said to be transferred to the ingoing side of the mill, and thence to the roll gap, through the nip between each work roll and its back-up roll.

Air seals were employed, evidently because contact seals engaging the work rolls, in particular, were likely to cause damage to the roll surface and hence to the strip. Also the seals would be unable to withstand the high temperature and dryness of the work rolls leaving the roll bite. However, air seals can create a water mist which may escape from the casings adjacent the roll bite and contaminate the rolled product. More importantly, coolant is carried over to the ingoing side of the mill through the work roll/back-up roll bites and delivered by the work rolls to the work at the bite between the work rolls. Consequently, the strip is again contaminated with the disadvantages mentioned above.

The British specification also has a FIG. 3 which shows the rolls at each side of the pass-line enclosed in a casing and coolant/lubricant applied at both the ingoing and the outgoing sides of the mill. Gaps are left between the casings and the work rolls at the roll bite and, according to the provisional specification, the interior of each casing is evacuated with the intention of preventing coolant passing through the gaps to the rolled material. It would however be impossible in practice to obtain in the casings sufficiently low pressures to remove from the work rolls coolant retained thereon by surface tension. Coolant would be carried by the work rolls into the work-roll bite and thence delivered to the surfaces of the strip.

The arrangements illustrated in the British specification would fail to give proper lubrication at the roll bite. If the lubricant is incorporated in the coolant, there are the dangers of it being inadequately distributed uniformly throughout the coolant and of non-uniform lubrication at the bite: if it is delivered separately from the lubricant, its effectiveness at the roll bite may be non-uniform because of the wetting of the work by the coolant as described above.

DISCLOSURE OF THE INVENTION

In the present invention, the coolant is applied only on the ingoing side of the mill in a casing or casings from which unwanted egress of coolant is effectively prevented; because of the direction of rotation of the rolls, there is no possibility of coolant being transferred though the bite between the work rolls and their back-up rolls and thence to the work at the outgoing side.

Secondly, only contact seals are used. Such seals, which are more effective than air seals in preventing escape of moisture, are possible because the rolls at the ingoing side of the mill are at a reasonably low temperature and because the contact seals are lubricated by the coolant. No coolant mist is generated and there is no escape route for the mist even if it were generated. The contact seals further act as cleaners for the rolls and prevent particulate material being carried into the roll bite by the rolls and damaging the rolls and the work.

Thirdly, rolling lubricant is applied separately from the coolant at the ingoing side of the mill and outside the casing or casings. The separate application of rolling lubricant is essential because of the effectiveness of the contact seals, but, apart from that, it enables the lubricant to be distributed more evenly, makes possible better control of the lubricant, and can result in better efficiency of lubricant usage.

Thus, one aspect of the invention resides in a method of rolling metal in a rolling mill, in which liquid coolant is applied to a roll or rolls only on the ingoing side of the mill within a casing or casings; by use of contact seals engaging the roll or rolls, unwanted egress of coolant from the casing or casings is prevented; and rolling lubricant is independently applied to the work and/or the work rolls at the ingoing side of the mill and outside the casing or casings.

Another aspect of the invention resides in a rolling mill which includes means for directing liquid coolant on to the rolls at only the ingoing side of the mill, a casing or casings enclosing the directing means and having contact seals engaging the roll or rolls to prevent unwanted egress of coolant from the casing or casings, and means located outside the casing or casings for applying rolling lubricant to the work and/or work rolls at the ingoing side of the mill.

The contact seals are lubricated by the coolant and, when the coolant is mainly water, a useful life of the seals can be obtained. However, by including in the coolant a lubricant which is particularly chosen to suit the material of the contact seals, the wear of the seals where they contact the moving rolls is reduced and, thus, the life of the seals is increased. Usually the liquid coolant is water based and the lubricant is miscible therewith. The contact seals may be of polyurethane elastomer, in which case the lubricant may be a composition comprising an amine salt or alkali metal salt of a dibasic carboxylic acid and a polyalkylene glycol.

The invention will be more readily understood, by way of example, from the following description of a rolling mill and its operation, reference being made to the accompanying drawings, in which.

DETAILED DESCRIPTION OF THE PREFERRED EMBODIMENTS

Figure 1:
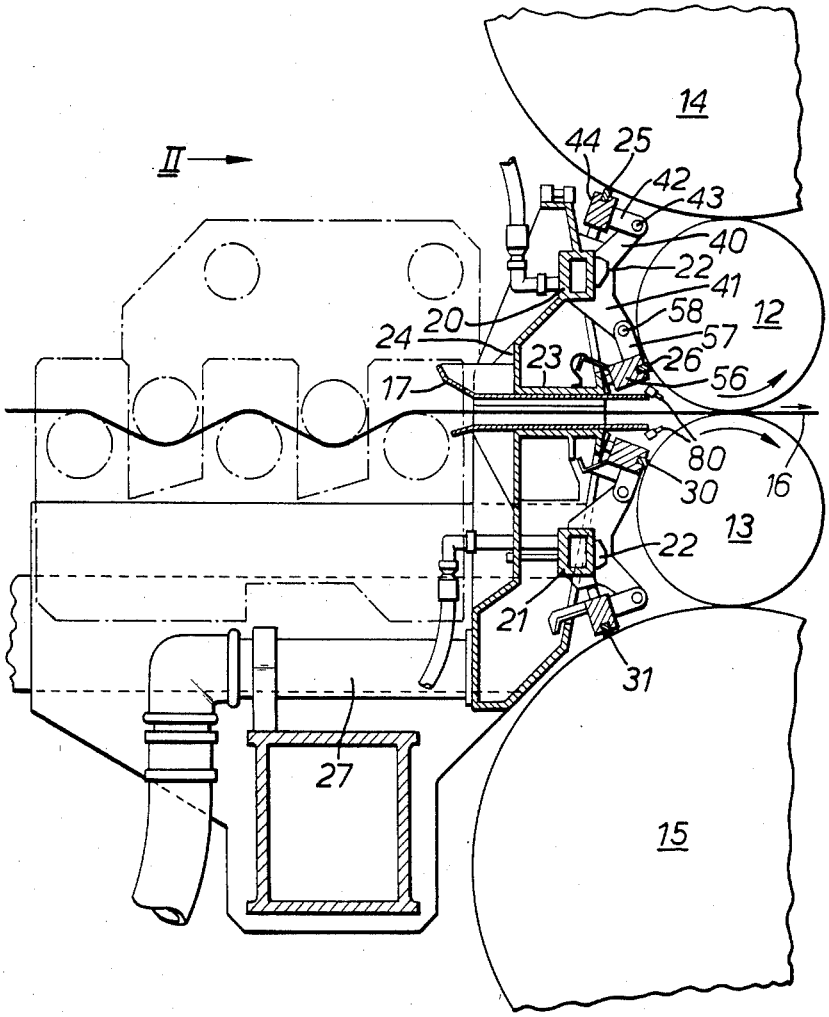
FIG. 1 is a section through the rolling mill.
Figure 2:
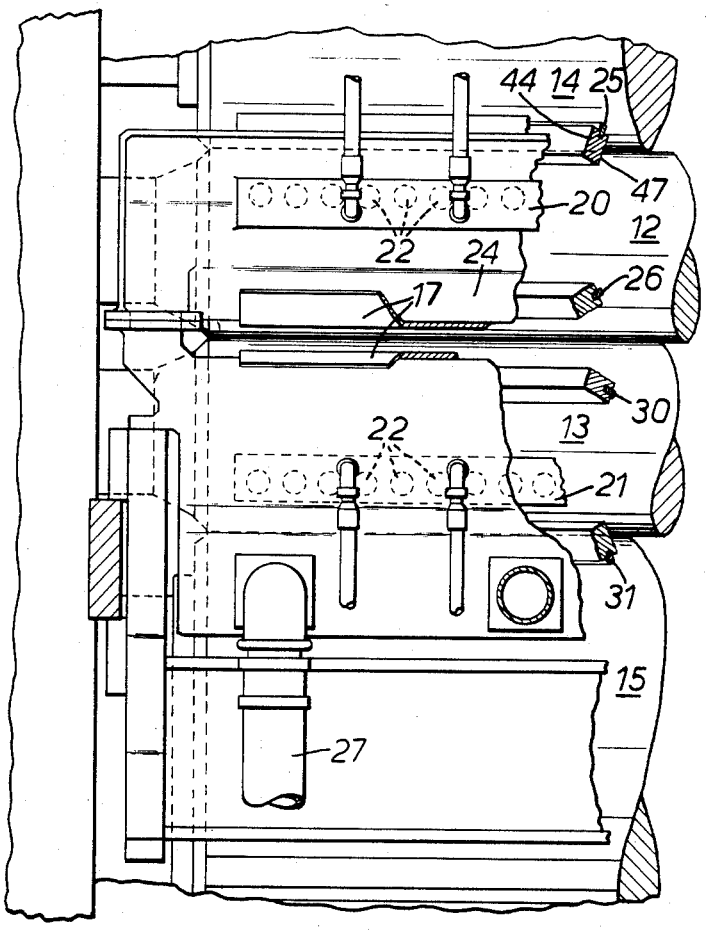
FIG. 2 is a view in the direction of the arrow II on FIG. 1.
Figure 3:
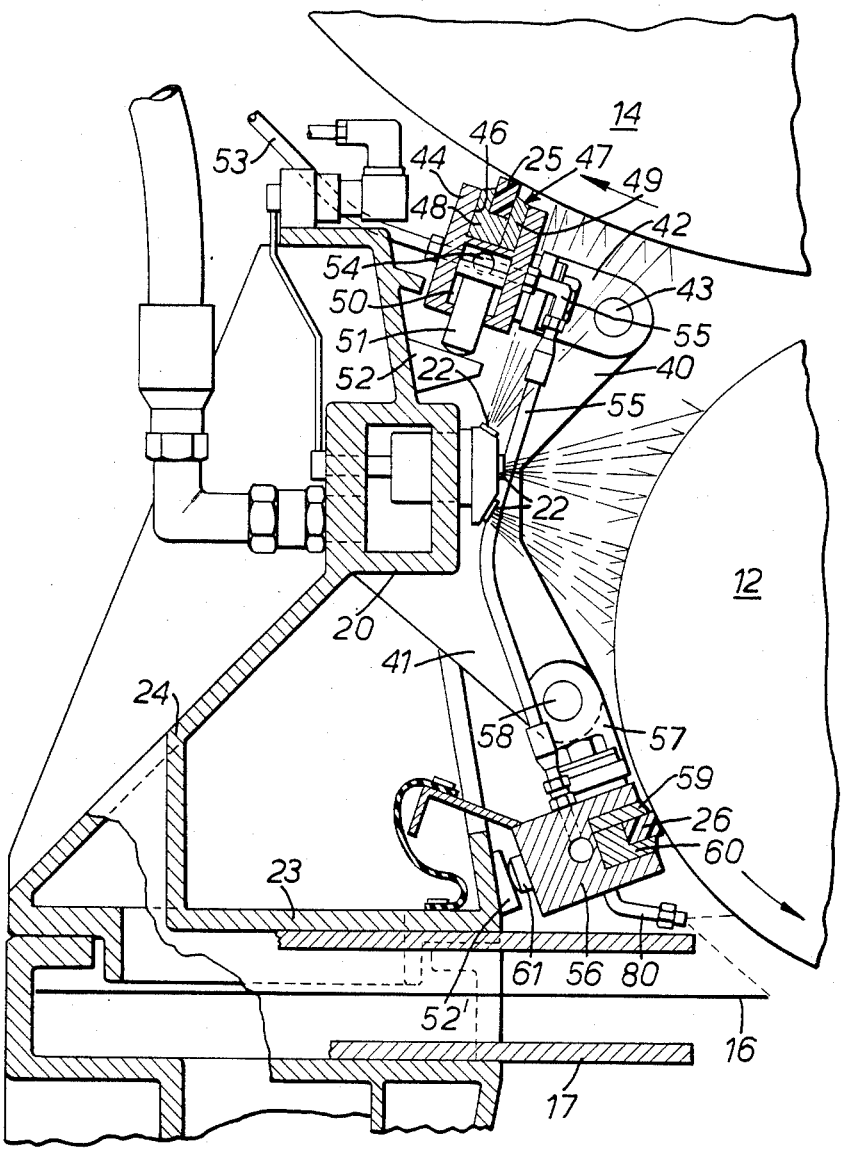
FIGS. 3 and 4 are section views to a larger scale showing details of the roll cooling means for the upper and lower rolls, respectively.

The mill shown in part in FIGS. 1 to 8 of the drawings has upper and lower work rolls 12, 13 and upper and lower back-up rolls 14, 15. The work—aluminium strip—is indicated at 16, the direction of movement of the work being from left to right, and the strip passing through a guide 17 to the roll gap. Coolant is applied to the roll at the ingoing side of the mill, i.e. at the left-hand side of the rolls in the drawing; spray bars 20 and 21 located respectively above and below the pass line extend the full length of the rolls and have at closely spaced intervals sets of spray nozzles 22 directed at the work rolls, the back-up rolls, and the bites between the work rolls and the back-up rolls. The spray bars are preferably as described in European Patent Specification No. 0041863 and British Patent Application No. 8404397. Each spray bar is located within a casing which contains totally the coolant discharged by the nozzles 22 and prohibits the egress of coolant on to the strip 16. As shown, the upper casing comprises a lower wall 23 secured to the guide 17 and a rear wall 24. A contact seal 25 is carried by the casing in a manner to be subsequently described and is urged against back-up roll 14, while a similar contact seal 26 pivoted to the casing is urged against the upper work roll 12 at the bottom of the casing and adjacent the bite between the work rolls. The casing and the seals 25 and 26 extend over the whole length of the rolls and the casing carries edge seals 19 which engage against the back-up roll 14 and work roll 12.

Figure 4:
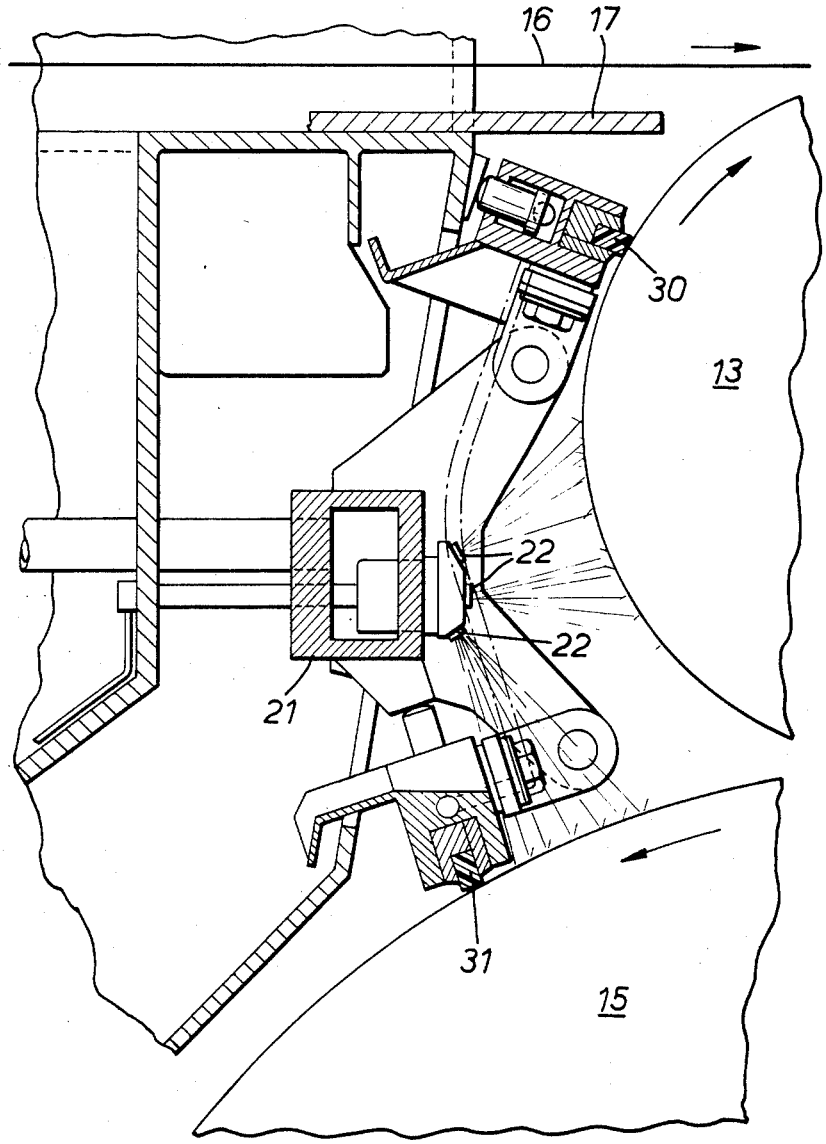
Figure 5:
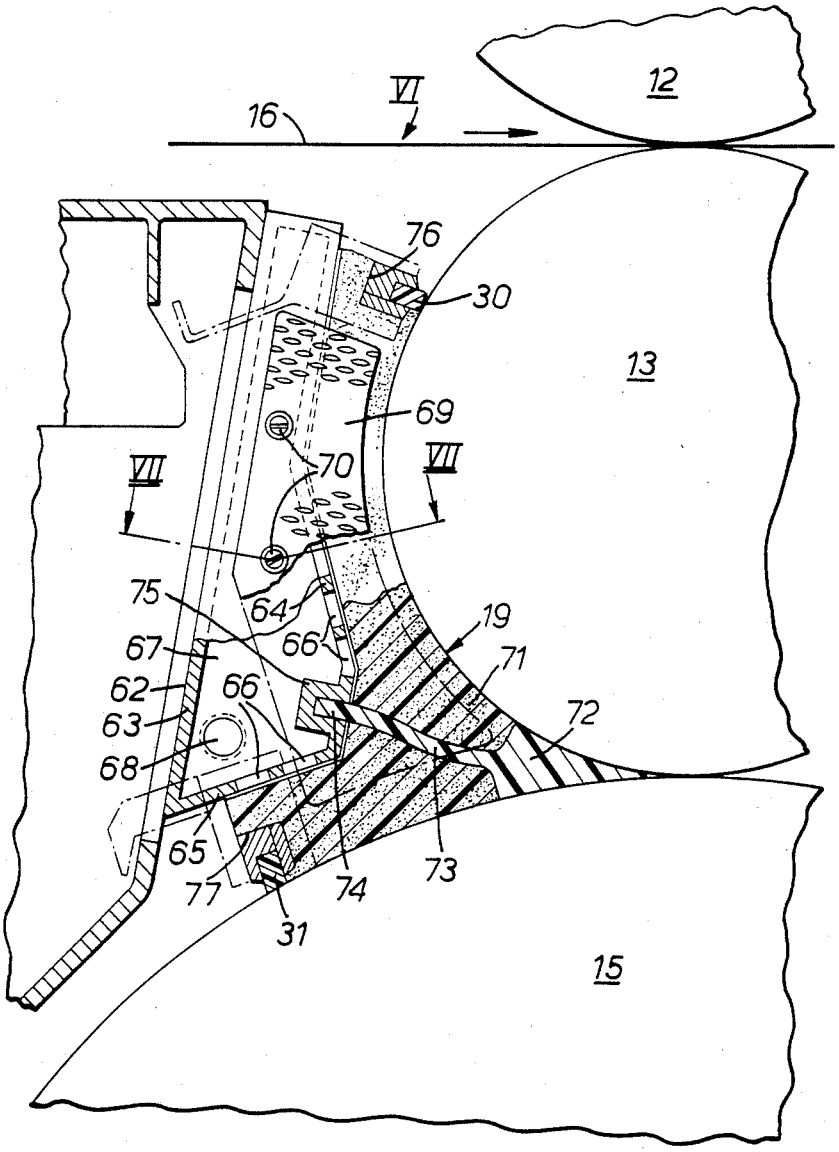
FIG. 5 is a section view showing end sealing means for the rolls.
Figure 6:
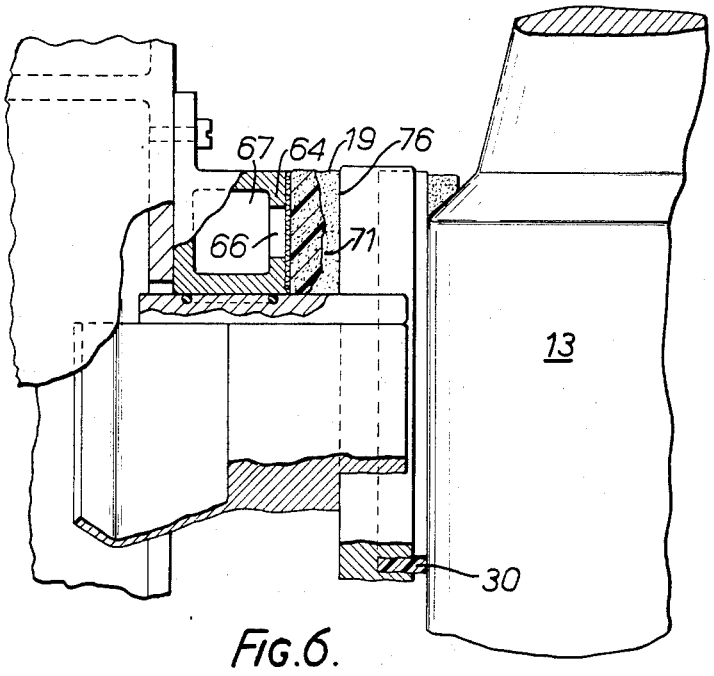
FIG. 6 is a scrap view in the direction of the arrow IV on FIG. 5.
Figure 7:
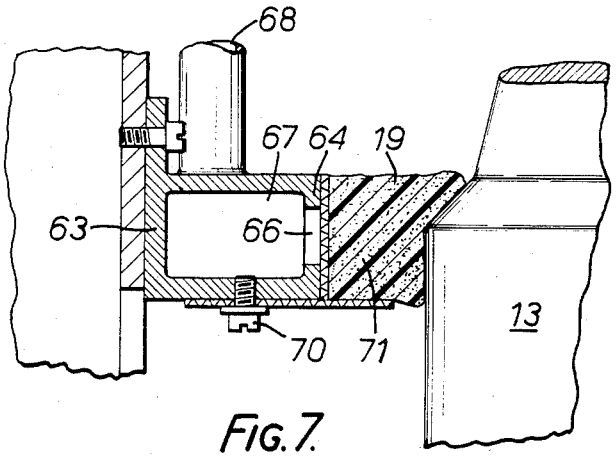
FIG. 7 is a section view on the line VII—VII of FIG. 5.
Figure 8:
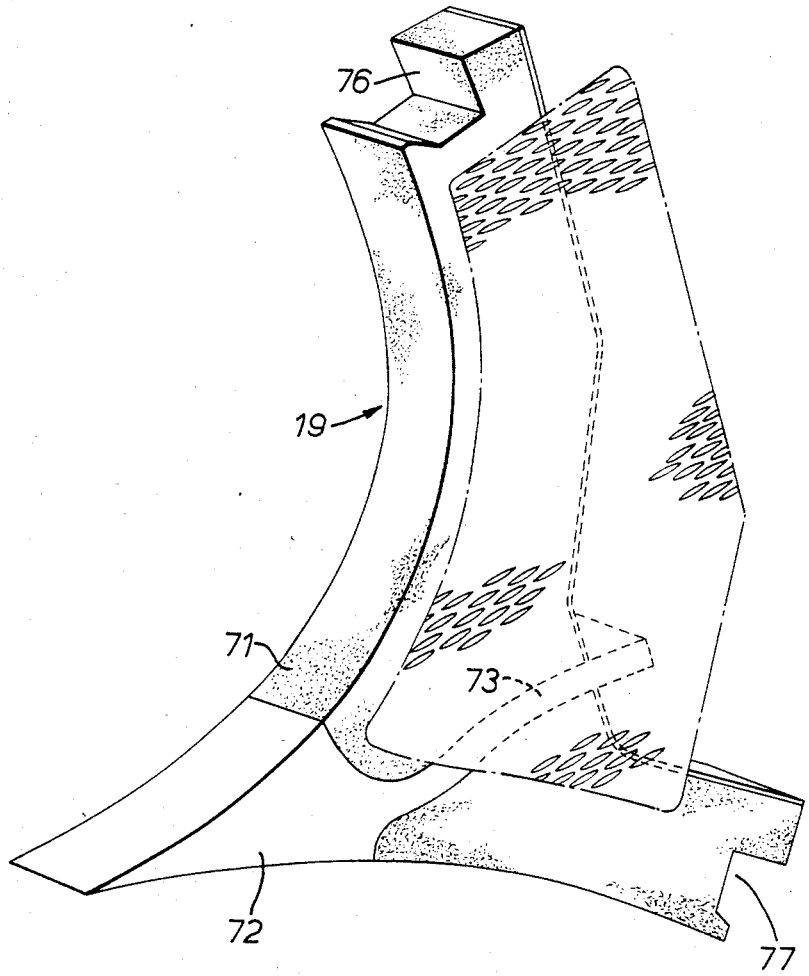
FIG. 8 is a perspective view of one of the end seals.

As seen clearly in FIG. 4, the lower spray bar 21 is contained in a lower, and similar, casing which is generally similar to the upper casing, except that it has an evacuation duct 27 by which coolant is removed from the two casings, which are connected together for that purpose. The lower casing is provided with contact seals 30 and 31 and edge seals 19 urged against the lower back-up roll 15 and the lower work roll 13, the mountings for those seals being similar in all respects to those for the upper work and back-up rolls.

Each end of the upper casing is provided with arms 40, 41 for mounting the seals 25, 26 respectively. A swinging arm 42 is pivoted at 43 to each arm 40 and has a bar 44 fixed thereto, the bar extending transversely across the width of the mill rolls and being formed with a groove 46 (see FIG. 3). Within the groove is carried a sealing cartridge 47 comprising a locating bar 48 and a clamping bar 49, the seal 25 being clamped therebetween. The bar 44 has a series of cylinders 50 formed therein and pistons 51 in each of these cylinders are normally forced by hydraulic fluid under constant pressure against lugs 52 formed on the casing, to rock the seal carrying bar 44 about the pivot 43 to cause the seal to engage the roll 14. The provision of a number of pistons 51 and cylinders 50 along the length of the bar 44 ensures good sealing contact with the roll across its entire length and prevents unwanted egress of coolant.

The hydraulic fluid is fed into the cylinders 50 by a pipe 53 and a bore 54 connecting each of the cylinders. An outlet pipe 55 from the bar 44 feeds the hydraulic fluid to a lower bar 56 where an arrangement somewhat similar to that of the bar 44 is provided. Thus, the bar 56 is fixed to swinging arms 57 pivoted at 58 to arms 41, and the seal is clamped by a clamping bar 59 to a locating bar 60. Pistons 61 acting on lugs 52' formed on the casing urge the seal 26 firmly against the roll 12.

In order to prevent egress of coolant from the ends of the casings, end seals 19 are provided as shown in FIGS. 5 to 8, which illustrate the end seals relating to the two lower rolls. Attached to the endmost portions of the lower casing are hollow box members 62, each having a rear wall 63, a front wall 64 and a lower wall 65, the front and lower walls being perforated at 66. The cavity 67 formed in the box members 62 is connected to a source of vacuum at 68. The edge seal 19 is secured to the box member 62 by means of plates 69 fastened by screws 70 to the sides of the box. The seal is formed of foamed plastics material 71, being shaped to conform approximately to the contour of the work roll and back-up roll as seen clearly in FIG. 5. That part of the seal which is adjacent the nip of the work roll and the back-up roll is formed as a semi-rigid polythene member 72 which has a rib 73 located at its end portion 74 in a slotted lug 75 formed in the front wall of the box member 62. The plastics foam 71 is provided with recesses 76, 77 located around the end portions of the transverse seal cartridges, and the entire edge seal, being of a resilient nature, conforms readily to the roll format and contour. As coolant fluid is wiped from the roll faces by the edge seal, it is sucked from the foam through the perforations 66 and evacuated by the vacuum source at 68. The edge seal described above is repeated at each end of the casing and a pair of similar seals are provided in respect of the upper pair of rolls.

Rolling lubricant is applied to both the work rolls 12 and 13 and to the strip 16 at the ingoing side of the mill and outside the confines of the two casings. Lubricant is supplied by two sets of nozzles 80 (FIG. 3) located on opposite sides of the pass line, one set being shown in FIG. 3; those nozzles are carried by the bar 56 and the corresponding bar of the lower work roll and are spaced apart over the length of the rolls and directed into the roll bite as shown.

The use of contact seals exclusively for the two casings is made possible because the direction of rotation of the rolls at the ingoing side of the mill is such that the seals 25, 26, 30 and 31 engage the surface of those rolls after having been cooled by the application of the coolant from the spray bars 20 and 21. As a result, the seals are in contact with wet, cooled surfaces and survive prolonged use before needing replacement. Also, because of the direction of the rolls on the ingoing side of the mill, coolant sprayed into the bites between the work rolls and their back-up rolls is carried by the rolls away from the bites, without any possibility of it being carried through the bites to the outgoing side of the mill. For that reason, and because of the effectiveness of the seals 25, 26, 30 and 31, no coolant is able to reach and mar the work 16.

More effective lubrication of the roll bite is achieved by the separate application of rolling lubricant, than is obtainable by having lubricant included in the coolant.

The lubricant is more evenly distributed over the width of the rolls and can be more accurately controlled according to the requirements. Each of the lubricant nozzles is capable of being controlled independently of the others on a mark/space basis; in other words, each nozzle 80 delivers lubricant in pulses, with the pulse length to duty cycle ratio and frequency being adjusted as required. By this means, the number and location of the nozzles applying lubricant can be varied according to the width of the strip 16 being rolled and for strip flatness control by varying the cooling effect of the lubricant along the strip width. Furthermore, the type of lubricant, and the rate at which it is delivered by each nozzle, can be varied from pass to pass, according to the nature of the metal being rolled.

The rate at which coolant is delivered by the nozzles 22 and the widthwise distribution of delivered coolant are similarly controllable by the valves supplied for the sets of nozzles, as described in British Patent Application No. 84043497. Differential cooling of the rolls is thus achieved again to control flatness of the strip.

Figure 9:
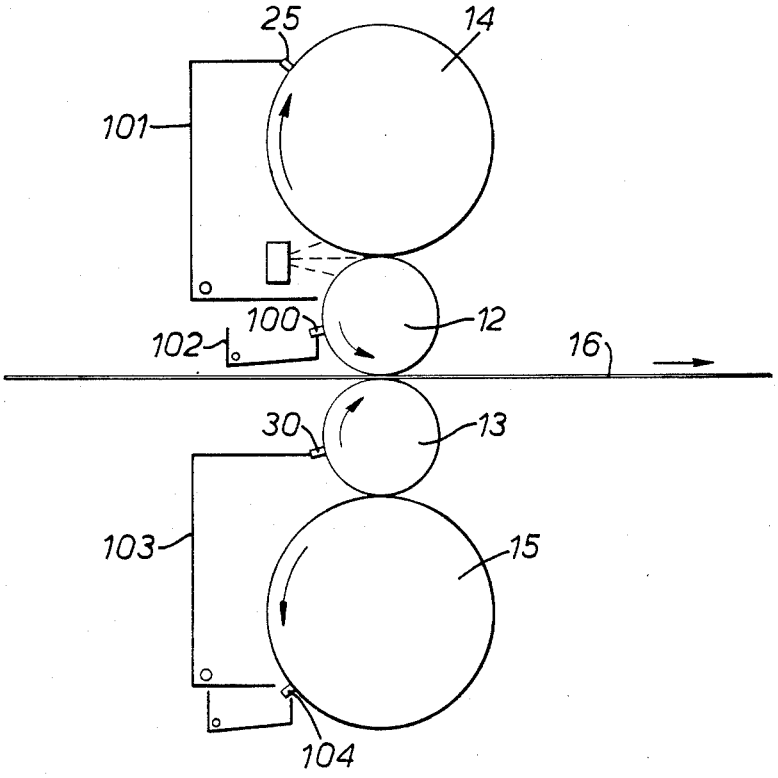
FIG. 9 shows a modification.

It is not always necessary to have the casings entirely sealed to the rolls provided that the coolant is otherwise prevented from contacting the work. For example, as schematically shown in FIG. 9, seal 100 engaging with the upper work roll 12 may be carried independently of the upper casing 101; the coolant stripped from work roll 12 is collected in receptacle 102 and removed therefrom. The contact seal for the upper back-up roll 14 and the edge seals for casing 101 may be as described above.

Below the pass-line, lower casing 103 may carry the contact seal 30 for the lower work roll 13 and the casing edge seals. However, contact seal 104 for the lower back-up roll may be carried independently of casing 103 and deliver coolant stripped from that roll into receptacle 104 for removal.

We claim:

1. A method of rolling a metal workpiece in a rolling mill while avoiding contact of the workpiece with a roll coolant, comprising the steps of:

providing a rolling mill having a pair of mill roll assemblies, each assembly comprising a work roll;

passing the workpiece between the pair of work rolls from an ingoing side to an outgoing side;

spraying liquid coolant from within a generally closed casing positioned at the ingoing side of the mill onto at least one roll of the mill roll assemblies;

preventing the egress of coolant from the casing by means of contact seals including mechanical members extending across the length of the roll or rolls;

urging the seals into contact with the roll or rolls and ensuring complete sealing contact therebetween across the entire length of the seals; and causing rolling lubricant to be applied to at least one of said work rolls outside the casing and on the ingoing side of the mill.

2. A method of rolling metal as claimed in claim 1, in which a lubricant for reducing wear of the contact seals is included with the coolant.

3. A method of rolling metal as claimed in claim 2, in which the coolant is water based and the lubricant is miscible therewith.

4. A method of rolling metal as claimed in claim 3, in which the seals are of polyurethane and the lubricant is a composition comprising an amine salt or alkali metal salt of a dibasic carboxylic acid and a polyalkylene glycol.

5. A method of rolling metal as claimed in claim 1, in which the mill has a back-up roll for each work roll and there is a separate casing for each work roll, the casing engaging, and being sealed to, the work roll and its back-up roll.

6. A method of rolling metal as claimed in claim 1, in which the rate at which rolling lubricant is delivered is adjustable and is set according to the parameters of the work and/or of the mill.

7. A method of rolling metal as claimed in claim 6, in which the delivery of rolling lubricant is adjusted for flatness control of the rolled work.

8. A method of rolling metal as claimed in claim 1, in which either the coolant is, or the coolant and the rolling lubricant are, varied both along the rolls and in delivery rate for control of flatness of the rolled work.

9. A method as claimed in claim 1, wherein said urging step comprises separately urging said seals at a plurality of positions along the length of the seals.

10. A rolling mill for separately applying and removing roll coolant and rolling lubricant and for preventing contact of the roll coolant with a workpiece, comprising:

a pair of mill roll assemblies, each assembly comprising a work roll, said mill having an ingoing side including one side of said rolls and an outgoing side including the other side of said rolls;

at least one generally closed casing provided at the ingoing side of the mill;

means for spraying liquid coolant from within the casing onto at least one roll of the mill roll assemblies;

contact seals provided on the casing engaging the roll or rolls to prevent egress of coolant from the casing, said seals extending across the entire length of the roll or rolls;

urging means, located along the length of the seals, for urging the contact seals into sealing engagement with the roll or rolls along the entire length of the roll or rolls; and means outside the casing for causing rolling lubricant to be applied to said work rolls at the ingoing side of the mill.

11. A rolling mill as claimed in claim 10, including means for introducing a lubricant for reducing wear of the contact seals into the coolant.

12. A rolling mill as claimed in claim 10, in which the coolant spraying means comprise nozzles which are spaced along the axial length of the rolls and which are controllable singly or in sets.

13. A rolling mill as claimed in claim 10, in which the rolling lubricant applying means comprise nozzles which are spaced along the axial length of the rolls or widthwise across the metal being rolled and which are controllable singly or in sets.

14. A rolling mill as claimed in claim 10, wherein said at least one pair of rolls are work rolls.

15. A rolling mill as claimed in claim 14, in which the mill has a back-up roll for each work roll, and there is a separate casing for each work roll with said contact seal adapted to engage the work roll and its back-up roll.

16. A rolling mill for separately applying and removing roll coolant and rolling lubricant and for preventing contact of the roll coolant with a workpiece, comprising:

a pair of mill roll assemblies including an upper and lower assembly, each assembly comprising a work roll and said upper assembly further including a back-up roll, said mill having an ingoing side including one side of said rolls and an outgoing side including the other side of said rolls;

at least one generally closed casing provided at the ingoing side of the mill adjacent said upper assembly;

means for spraying liquid coolant from within the casing onto at least one roll of the mill roll assemblies;

contact seals provided on the casing and including a mechanical member engaging each roll to prevent egress of coolant from the casing by stripping the coolant from the roll; and means outside the casing for causing rolling lubricant to be applied to said work rolls at the ingong side of the mill.

17. A rolling mill as claimed in claim 16, further comprising urging means, located along the length of the seals, for urging the contact seals into sealing engagement with each roll along the entire length of the roll.

18. A method of rolling a metal workpiece in a rolling mill while avoiding contact of the workpiece with roll coolant, comprising the steps of:

providing a rolling mill having a pair of mill roll assemblies including an upper and lower assembly, each assembly comprising a work roll and said upper assembly further including a back-up roll, said mill having an ingoing side including one side of said rolls and an outgoing side including the other side of said rolls;

passing the workpiece between the pair of work rolls from the ingoing side to the outgoing side;

spraying liquid coolant from within a generally closed casing onto at least the upper assembly of the mill roll assemblies;

preventing the egress of coolant from the casing by means of contact seals including a mechanical member engaging each roll of said upper assembly to strip coolant from the rolls; and causing rolling lubricant to be applied to at least one of said work rolls ouside the casing on the ingoing side of the mill.

* * * * *